US011852450B2

(12) United States Patent
Birkin et al.

(10) Patent No.: US 11,852,450 B2
(45) Date of Patent: Dec. 26, 2023

(54) METHOD OF ASSEMBLING A DETONATOR

(71) Applicant: DETNET SOUTH AFRICA (PTY) LTD, Johannesburg (ZA)

(72) Inventors: Christopher Malcolm Birkin, Centurion (ZA); Michiel Jacobus Kruger, Johannesburg (ZA); Richard Joseph Michna, Barkhamsted, CT (US); Andre Louis Koekemoer, Boksburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 346 days.

(21) Appl. No.: 17/421,829

(22) PCT Filed: Jan. 24, 2020

(86) PCT No.: PCT/ZA2020/050008
§ 371 (c)(1),
(2) Date: Jul. 9, 2021

(87) PCT Pub. No.: WO2020/160574
PCT Pub. Date: Aug. 6, 2020

(65) Prior Publication Data

US 2022/0099416 A1 Mar. 31, 2022

(30) Foreign Application Priority Data

Jan. 28, 2019 (ZA) ..... 2019/00555

(51) Int. Cl.
*F42B 3/195* (2006.01)
*F42D 1/04* (2006.01)

(52) U.S. Cl.
CPC ..... *F42B 3/195* (2013.01); *F42D 1/043* (2013.01)

(58) Field of Classification Search
CPC ..... F42B 3/195; F42D 1/043
See application file for complete search history.

(56) References Cited

U.S. PATENT DOCUMENTS

| | | | | |
|---|---|---|---|---|
| 5,522,318 | A | 6/1996 | Gladden et al. | |
| 5,945,627 | A * | 8/1999 | Arpin | C06C 7/00 102/275.9 |
| 8,967,048 | B2 | 3/2015 | Harding et al. | |
| 9,279,645 | B2 * | 3/2016 | Schlenter | F42D 1/043 |
| 11,604,054 | B2 * | 3/2023 | Kruger | F42C 15/36 |
| 11,604,055 | B2 * | 3/2023 | Birkin | F42D 1/043 |

(Continued)

OTHER PUBLICATIONS

International Search Report for PCT/ZA2020/050008, international filing date of Jan. 24, 2020, dated Jun. 9, 2020, 3 pages.

(Continued)

*Primary Examiner* — Nirvana Deonauth
(74) *Attorney, Agent, or Firm* — CANTOR COLBURN LLP

(57) ABSTRACT

A detonator assembly method wherein a base charge is placed into a tube to abut a closed end of the tube, an electronic module is positioned inside the tube, a displacement member with a stop formation is used to move the module, against a frictional restraining force, to a location at which the stop formation abuts a rim of the tube and wherein the module is held in position by deforming the tube into engagement with the module.

6 Claims, 3 Drawing Sheets

(56) References Cited

U.S. PATENT DOCUMENTS

| | | | | |
|---|---|---|---|---|
| 2002/0152913 | A1* | 10/2002 | Bernard | F42D 1/045<br>102/304 |
| 2005/0016409 | A1 | 1/2005 | Husk et al. | |
| 2005/0066832 | A1 | 3/2005 | Mausy | |

OTHER PUBLICATIONS

Written Opinion for PCT/ZA2020/050008, international filing date of Jan. 24, 2020, dated Jun. 9, 2020, 6 pages.

* cited by examiner

METHOD OF ASSEMBLING A DETONATOR

CROSS-REFERENCE TO RELATED APPLICATIONS

This application is a U.S. national stage application of International Application No. PCT/ZA 2020/050008 entitled "METHOD OF ASSEMBLING A DETONATOR", which has an international filing date of 24 Jan. 2020, and which claims priority to South African Patent Application No. 2019/00555, filed 28 Jan. 2019.

This invention relates to a method of assembling a detonator which is used in conjunction with a shock tube. That type of detonator is described, for example, in the specification of U.S. Pat. No. 8,967,048.

BACKGROUND OF THE INVENTION

A detonator of the kind in question is triggered by a shock tube event. An end of a shock tube is coupled to a casing in which an electronic module and sensors are positioned. When the shock tube is ignited a shock tube event is generated and is emitted from the end of the shock tube. The shock tube event which includes plasma and light, and which is accompanied by a temperature rise and a pressure wave, impacts on the electronic module. If the electronic module is not properly positioned inside the casing, the effect of the shock tube event can be such that the module is displaced from an installed position and can be moved to contact a base charge in the casing. Also elements of the shock tube event can bypass the module, reach the base charge which is downstream of the module and cause inadvertent initiation of the detonator.

The invention is concerned with a method of assembling a detonator of the kind referred to in which the risk associated with the aforementioned issues is reduced.

SUMMARY OF THE INVENTION

The invention provides a method of assembling a detonator which includes; a tubular casing, the tubular casing having a closed end, an opposed open end, a rim at the open end, and a bore extending between the open end and the closed end; a base charge, and an electronic module which includes a moulded plastics body to which is secured an electronic circuit, the method including the steps of:

(1) inserting the base charge into the bore of the casing;
(2) displacing the base charge to abut an inner surface of the closed end;
(3) inserting the body of the module into the bore;
(4) displacing the body inside the bore so that a leading end of the body is moved towards the base charge to a predetermined location at which a friction member on the body abuts the rim at the open end with a trailing end of the body extending from the open end;
(5) engaging a displacement member with the body, the displacement member including a cylindrical projection which has a contact surface, which abuts the trailing end, and a stop formation which is at a predetermined distance from the contact surface;
(6) using the displacement member to move the body along the bore towards the base charge against a sliding frictional resistance force produced by interengagement of the body and an opposing inner surface of the casing, until the stop formation abuts the rim at the open end; and (7) deforming a portion of the casing into engagement with a retention formation on the body thereby to secure the body to the casing with the body at a predetermined position inside the casing.

The deformation process may include a crimping action whereby a depression is formed in an outer surface of the casing. The crimping action may result in a mechanical or frictional engagement of the casing with the body. Optionally the crimping action forces a part of the casing into engagement with a locating formation on the body.

An outer surface of the body between the leading end and the friction member may be such that movement of the body into the bore is achieved with a first degree of force and further movement of the body into the bore is only possible with a second degree of force which is higher than the first degree of force—the increase in force is due to the necessity to overcome the frictional resistance force produced by the friction member contacting the inner surface of the casing.

BRIEF DESCRIPTION OF THE DRAWINGS

The invention is further described by way of example with reference to the following drawings in which.

DESCRIPTION OF PREFERRED EMBODIMENT

Figure 1:
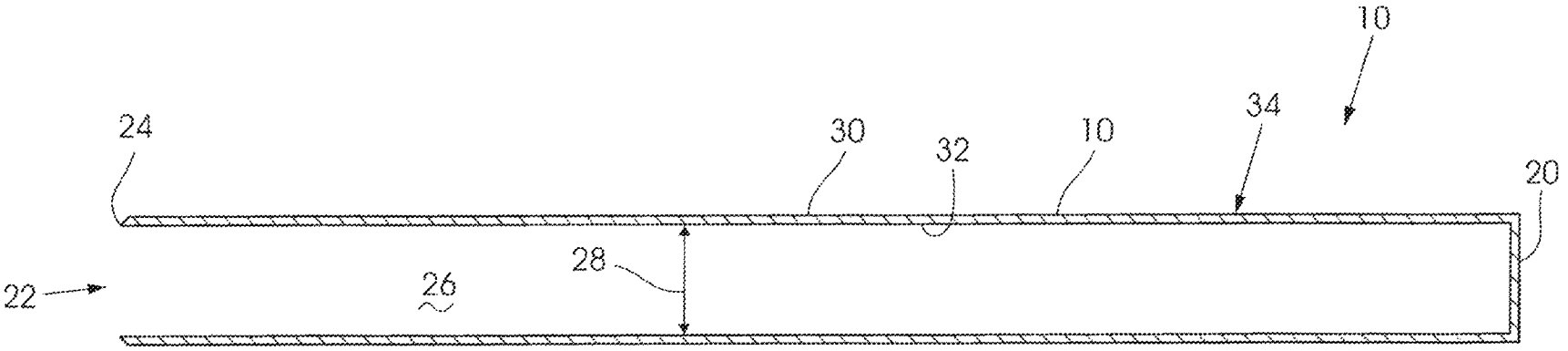
FIG. 1 illustrates from one side and in cross section a tubular casing which is used in a detonator according to the invention.
Figure 6:
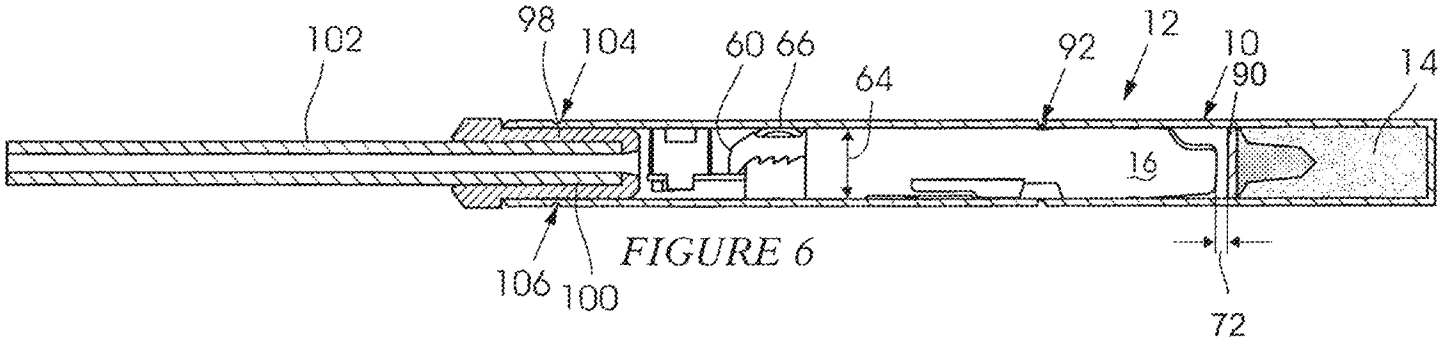
FIG. 6 shows a detonator assembled according to the invention.

FIG. 1 of the accompanying drawings is a side view in cross-section of a tubular metallic casing 10 which is used as a housing for an electronic detonator 12 according to the invention (see FIG. 6).

Figure 2:
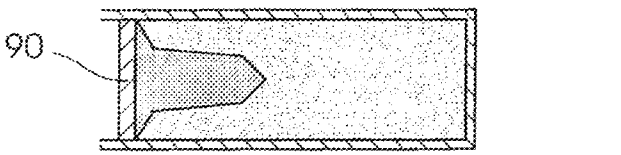
FIG. 2 shows from one side a base charge which is included in the detonator of the invention.
Figure 3:
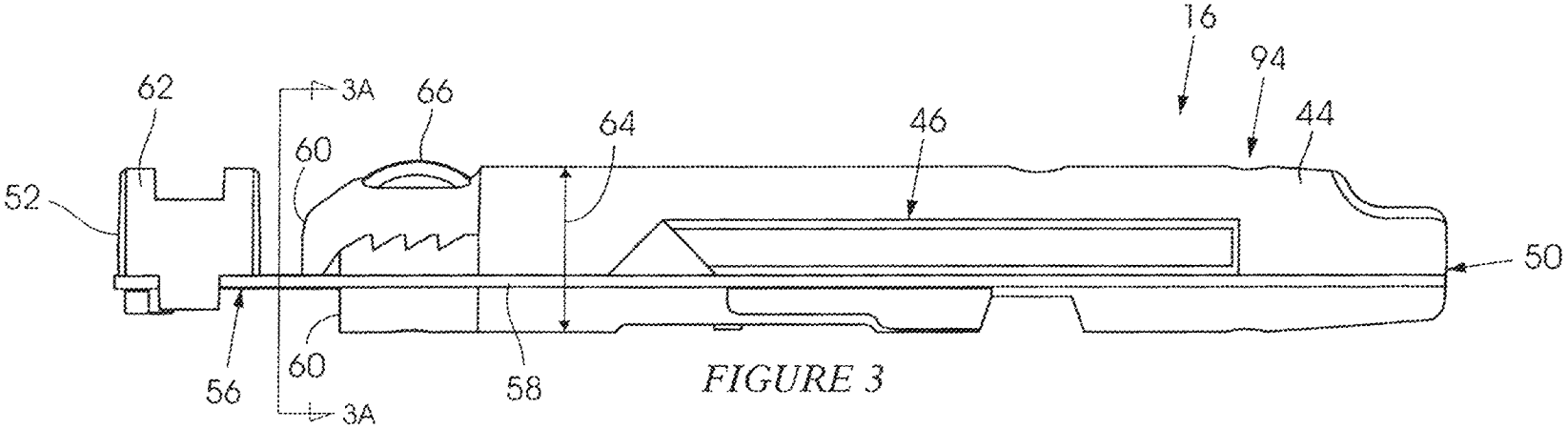
FIG. 3 shows from one side an electronic module included in the detonator.

FIG. 2 shows from one side a base charge 14 while FIG. 3 shows, from one side, an electronic module 16. The base charge 14 and the module 16 are included in the fully assembled detonator 12.

The tubular casing 10 has a closed end 20, an open end 22 which is surrounded by a rim 24, and a bore 26 with a diameter 28. The casing 10 is made from a thin-walled copper material 30 with an inner surface 32, and an outer surface 34.

Figure 4:
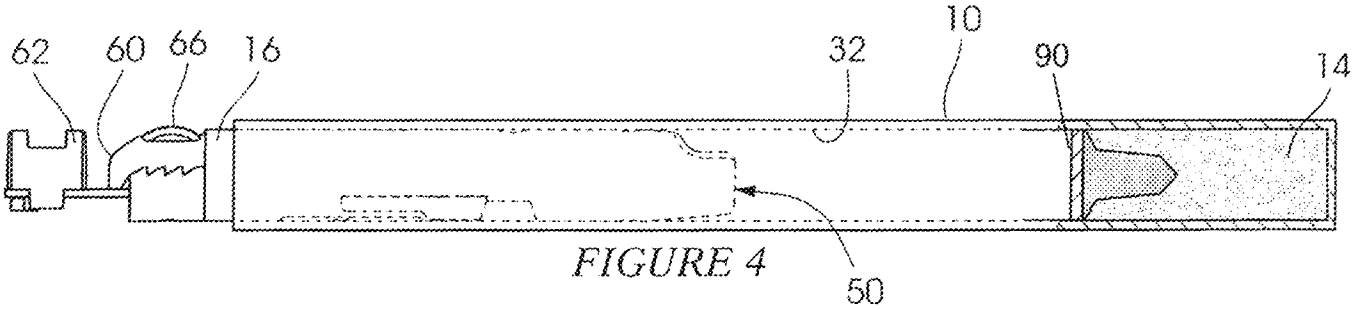
FIG. 4 illustrates from one side and in cross section a detonator at an intermediate stage of assembly thereof.

The base charge 14 is of predetermined dimensions and shape and is configured to fit inside the bore 26 abutting the inner surface 32 at the closed end 20, as is indicated in FIG. 4.

FIG. 3 shows from one side and in cross section the electronic module 16. The module 16 includes a moulded plastics body 44 and an electronic circuit 46 which is only notionally shown and which is embedded in the body 44. The module 16 has a leading end 50 and a trailing end 52. A portion 56 of a substrate 58, to which most of the components of the circuit 46 are mounted, protrudes from a rear end 60 of the body 44. A housing 62 which contains sensing components essential for the working of the detonator 12 is attached to the portion 56.

Figure 3A:
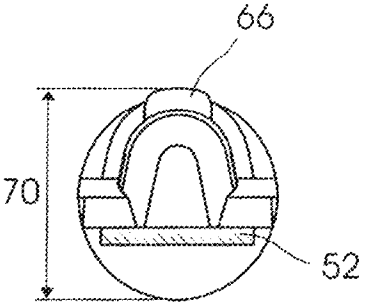
FIG. 3A is an end view of a body of the module taken on a line 3A-3A in FIG. 3.

A major portion of the body 44 has a diameter 64 which is only slightly less than the diameter 28. Adjacent the rear end 60 the body 44 is formed with at least one protrusion 66, see the end view of the body of the module shown in FIG. 3A. In this embodiment the protrusion 66 is formed from the same material as the body 44. However, the protrusion can be a separate component and can be made from a material which is different to that employed in the body 44. In any event, the material is slightly resiliently deformable. A diametrical dimension 70, (shown in FIG. 3A) of the body 44 which includes the thickness of the protrusion 66, is slightly more than the diameter 28.

In a first assembly step the base charge 14 is inserted into the bore 26 and is pushed to abut the inner surface 32 at the closed end 20 of the casing 10. There is a slight degree of frictional interengagement between the module 16 and the inner surface 32 of the tubular casing 10, but the module 16 can move relatively freely to the closed end 20 of the casing 10 and, once correctly located there, remains in position.

In a second assembly step the leading end 50 of the module 16 is inserted into the open end 22. The module 16 is then moved in an axial direction 74 along the bore 26 towards the base charge 14. Such initial movement of the module is initially relatively friction-free for, as noted, the diametrical dimension 64 is slightly less than the diameter 28, and no meaningful frictional retention forces are generated which impede movement of the body 44 into the bore 26. This situation prevails until such time as the protrusion 66 abuts the rim 24 at the open end 22.

Figure 5:
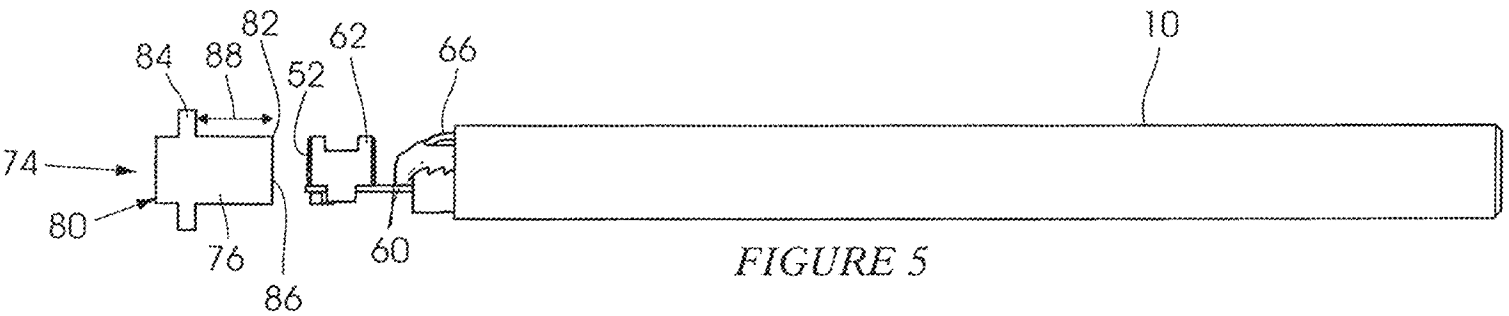
FIG. 5 illustrates the use of a displacement member to position an electronic module precisely inside the casing.

Viewed from one side, the protrusion 66 has an arcuate form. Thus a portion of the protrusion 66 can enter the open end 22 and the protrusion can thereafter be advanced into the bore 26 only by exerting an axially directed force onto the trailing end 52 of the module 66, which force is sufficiently high to deform the protrusion 68. Further movement of the module 16 into the casing 10 is achieved through the use of a displacement member 76 of the kind shown in FIG. 5.

The displacement member 76 includes a body 80 which has a cylindrical projection 82 and a stop formation 84 which is in the form of a flange which surrounds the cylindrical projection 82 and which is spaced from a force application surface 86 in an axial direction by a distance 88. The surface 86 is brought into abutment with the trailing end 52 and, by applying an axially directed force to the displacement member 76, the module 16 is urged into the bore 26. The protrusion 66 is deformed inwardly in a radial sense so that it does not prevent sliding movement of the module 16 into the bore 26 but produces a frictional resistance to such movement. The force which is exerted in the axial direction 74 by the displacement member 76 is sufficient to overcome the resistance force generated by interengagement of the protrusion 66 with the inner surface 32 of the wall of the casing 10.

The displacement member 76 is used to apply force steadily to the module 16. The cylindrical projection 82 is advanced into the bore 26 of the casing 10 until such time as the stop formation 84 is brought into abutment with the rim 24 of the casing 10. At this point the module 16 is correctly positioned inside the bore 26 and the leading end 50 is spaced by a predetermined distance 72 from an opposed surface 90 of the base charge 14 (FIG. 6). When the displacement member 76 is disengaged from the casing 10 the module 16 remains in position for the protrusion 66 remains deformed and keeps the body 44 frictionally engaged with the inner surface 32 of the casing.

The module 16 is then fixed in position inside the tubular casing 10 by means of a crimp formation 92 which deforms a portion of the metallic casing 10 into mechanical engagement with an outer surface of the body 44. In this way the module is securely locked to the casing 10.

Subsequent to the placement of the module 16 in the casing 10 a plug 98 to which is attached an end 100 of a shock tube 102, shown in FIG. 6, is inserted into the open end 22. The casing 10 is crimped (104, 106) to complete the assembly process.

The technique described has a number of benefits. Firstly the electronic module 16 is precisely positioned inside the casing 10 at a location at which the leading end 50 is correctly positioned relative to the base charge 14 and at which the trailing end 52 is correctly positioned relative to the end 100 of the shock tube 102.

Secondly, the mechanical interlock provided by the crimp 92, which retains the module 16 in position, is such that the effect of a shock tube event impacting on the trailing end 52 of the module 16 is not capable of displacing the module 16 into contact with the base charge 14.

Thirdly, a sealing effect is achieved by the close interengagement of the module 16 with the casing 10—the effect thereof is that plasma, heat, light and a pressure wave, produced by a shock tube event applied to the detonator 12 at the open end 22, do not bypass the module 16 and cannot therefore reach the base charge 14 to cause inadvertent initiation thereof.

The invention claimed is:

1. A method of assembling a detonator which includes a tubular casing, the casing having a closed end, an opposed open end, a rim at the open end, and a bore extending from the open end to the closed end, a base charge, and an electronic module which includes a moulded plastics body to which is secured an electronic circuit, the method including the steps of:

1) inserting the base charge into the bore of the casing;
2) displacing the base charge to abut an inner surface of the closed end;
3) inserting the body of the module into the bore;
4) displacing the body inside the bore so that a leading end of the body is moved towards the base charge to a predetermined location at which a friction member on the body abuts the rim at the open end with a trailing end of the body extending from the open end;
5) engaging a displacement member with the body, the displacement member including a cylindrical projection which has a contact surface, which abuts the trailing end, and a stop formation which is at a predetermined distance from the contact surface;
6) using the displacement member to move the body along the bore towards the base charge against a sliding frictional resistance force produced by interengagement of the body and an opposing inner surface of the casing, until the stop formation abuts the rim at the open end; and
7) deforming a portion of the casing into engagement with a retention formation on the body thereby to secure the body to the casing with the body at a predetermined position inside the casing.

2. A method according to claim 1 wherein the step of deforming includes a crimping action whereby a depression is formed in an outer surface of the casing resulting in a mechanical engagement of the casing with the body.

3. A method according to claim 2 wherein the crimping action forces a part of the casing into engagement with a locating formation on the body.

4. A method according to claim 1 wherein an outer surface of the body, between the leading end and the friction member is such that movement of the body into the bore is achieved with a first degree of force and further movement of the body into the bore is only possible with a second degree of force which is higher than the first degree of force.

5. A method according to claim 2 wherein an outer surface of the body, between the leading end and the friction member is such that movement of the body into the bore is achieved with a first degree of force and further movement of the body into the bore is only possible with a second degree of force which is higher than the first degree of force.

6. A method according to claim 3 wherein an outer surface of the body, between the leading end and the friction member is such that movement of the body into the bore is achieved with a first degree of force and further movement of the body into the bore is only possible with a second degree of force which is higher than the first degree of force.

* * * * *